United States Patent [19]

Ellington

[11] Patent Number: 4,913,440

[45] Date of Patent: Apr. 3, 1990

[54] GOLF CLUB SWING TRAINING APPARATUS

[75] Inventor: Carroll M. Ellington, Charlotte, N.C.

[73] Assignee: Performance Golf Products, Inc., Charlotte, N.C.

[21] Appl. No.: 278,660

[22] Filed: Dec. 1, 1988

[51] Int. Cl.[4] ..... A63B 69/36

[52] U.S. Cl. ..... 273/186 R; 273/183 A

[58] Field of Search ..... 273/186 R, 186 C, 191 R, 273/191 A, 191 B, 192, 183 A

[56] References Cited

U.S. PATENT DOCUMENTS

| | | | |
|---|---|---|---|
| 2,712,939 | 7/1955 | Harp | 273/186 R |
| 3,107,920 | 10/1963 | Strunk | 273/186 R |
| 3,194,565 | 7/1965 | Schroer | 273/186 R |
| 3,586,335 | 6/1971 | D'Antonie | 273/186 C |
| 3,741,550 | 6/1973 | Landures | 273/186 R |
| 4,465,281 | 8/1984 | Whitfield | 273/186 R |
| 4,526,373 | 7/1985 | Medlock | 273/186 R |
| 4,732,390 | 3/1988 | McCollum | 273/186 R |
| 4,826,174 | 5/1989 | Hoyt | 273/186 R |

FOREIGN PATENT DOCUMENTS

| | | | |
|---|---|---|---|
| 383767 | 11/1932 | United Kingdom | 273/186 R |

*Primary Examiner*—George J. Marlo

*Attorney, Agent, or Firm*—Shefte, Pinckney & Sawyer

[57] ABSTRACT

A golf club swing training device provides a base, preferably in the form of a mat having an artificial grass surrface, with a plurality of openings at predetermined locations spaced about the mat for selective disposition of upstanding swing guide members to permit the user to arrange the guide members to define any desired golf club swing path, e.g. an inside-to-square path for full golf swings or a straight path for chipping swings. A mirror-image set of guide member placement locations is provided to enable the mat to be used by both left-handed and right-handed golfers.

10 Claims, 3 Drawing Sheets

GOLF CLUB SWING TRAINING APPARATUS

BACKGROUND OF THE INVENTION

The present invention relates generally to golf training aids and, more particularly, to apparatus for training a user to swing a golf club in a predetermined desired swing path.

The physical mechanics of swinging a golf club properly are among the most difficult of all athletic movements to master. One of the fundamental principals of a correct golf club swing is that the club head should follow an oblique swing path with respect to the intended line of ball travel moving from the golfer's side of such line in advance of squarely striking the ball and then diverging from such line to the same side thereof following the striking of the ball. This swing path is commonly referred to as an "inside-out" swing path, but more recently has begun to be referred to more properly as an "inside-to-square-to-inside," or simply "inside-to-square," swing path. Many of the individual mechanical movements of a correct golf swing are related to the ultimate goal of swinging the golf club in a proper swing plane so that the club head follows such an inside-to-square path. Likewise, many of the problems many golfers suffer are directly related to their development of an improper golf swing which does not follow such a desired path. For example, a golf club head following an opposite outside-in swing path in striking a golf ball characteristically produces a "slicing" of the ball wherein the ball undesirably curves in one direction away from the desired line of travel. On the other hand, an overly exaggerated inside-to-square swing path of a golf club head in striking a ball causes the ball to "hook" wherein the ball curves in the other direction away from the intended line of travel.

Many diverse devices have been proposed in the past for use by golfers in training themselves to swing a golf club in a correct inside-to-square swing plane. One type of such device provides a mat or similar structure for use in practicing one's golf swing at a driving range or other suitable practice facility, wherein the device is provided with a series of posts or projections located in relation to a golf ball striking area to require a golf club head to follow a certain swing path in order to properly strike a ball positioned at the striking area without also striking one or more of the posts or projections. Representative examples of various forms of this type of device are disclosed in U.S. Pat. Nos. 2,712,939; 3,194,565; 3,107,920; 3,586,335; 3,741,550; and 4,526,373. While such devices can be generally effective for their intended purpose, it will be understood that the same device is not necessarily well-suited for all golfers. For example, the optimal inside-to-square swing path will vary from one golfer to the next depending on the golfer's height, whether his typical stance is upright or crouched, etc. Likewise, certain golf shots, most notably chip shots, are desirably made by swinging a golf club so that its club head follows a path of travel which is substantially aligned with, rather than oblique to, the desired direction of ball travel and, accordingly, such prior devices may not be usable for practicing such golf shots. Finally, some golfers use a naturally left-handed swing rather than the more predominant right-handed swing of most golfers so that practice devices designed specifically for right-handed golfers are generally useless to a left-handed golfer.

SUMMARY OF THE INVENTION

It is accordingly an object of the present invention to provide a golf club swing training device which solves the aforementioned problems. Specifically, it is an object of the present invention to provide such a training device wherein swing guide members may be selectively positioned to accommodate a variety of desirable golf club swing paths.

Briefly summarized, the golf club swing training device of the present invention basically includes a generally planar base for disposition on a generally flat practice surface in generally parallel facing relation to the surface. A plurality of swing guide members are provided with the device, the base defining a plurality of placement locations each of which is adapted for removable disposition thereat of one guide member in upstanding relation with respect to the base. The placement locations are arranged at spacings about the base to permit the guide members to be selectively positioned in diverse relationships with respect to one another for cooperatively defining a variety of possible golf club swing paths to accommodate differing swing training uses.

In the preferred embodiment of the present invention, the base has a central swing path area which extends between forward and rearward ends of the base for disposition of the base during use with the central area essentially parallel to a user's stance along one lateral side of the base. The placement locations for the swing guide members are arranged at opposite lateral sides of the central area. For example, it is preferred that one or more sets of the placement locations be arranged along the side of the central area opposite the user's stance in differing oblique alignments with respect to the user's stance for defining various possible oblique "inside-to-square" swing paths when a corresponding set of the guide members is positioned at one set of the placement locations. It is further preferred that another set of placement locations be arranged along the same side of the central area, i.e. opposite the user's stance, in an alignment extending parallel with respect to the user's stance to define a parallel swing path when a corresponding set of the guide members is positioned at such set of placement locations. Corresponding sets of placement locations may be provided along the other side of the central area in generally mirror-image relationship to the described sets of placement locations to accommodate another user of the opposite hand. Each such placement location preferably is formed as an opening in the base, with each guide member being configured to be received in a fitted fashion in one of the openings. Additionally, a tee may be removably mounted in the central area of the base for selective use in supporting a golf ball.

DESCRIPTION OF THE PREFERRED EMBODIMENT

Figure 1:
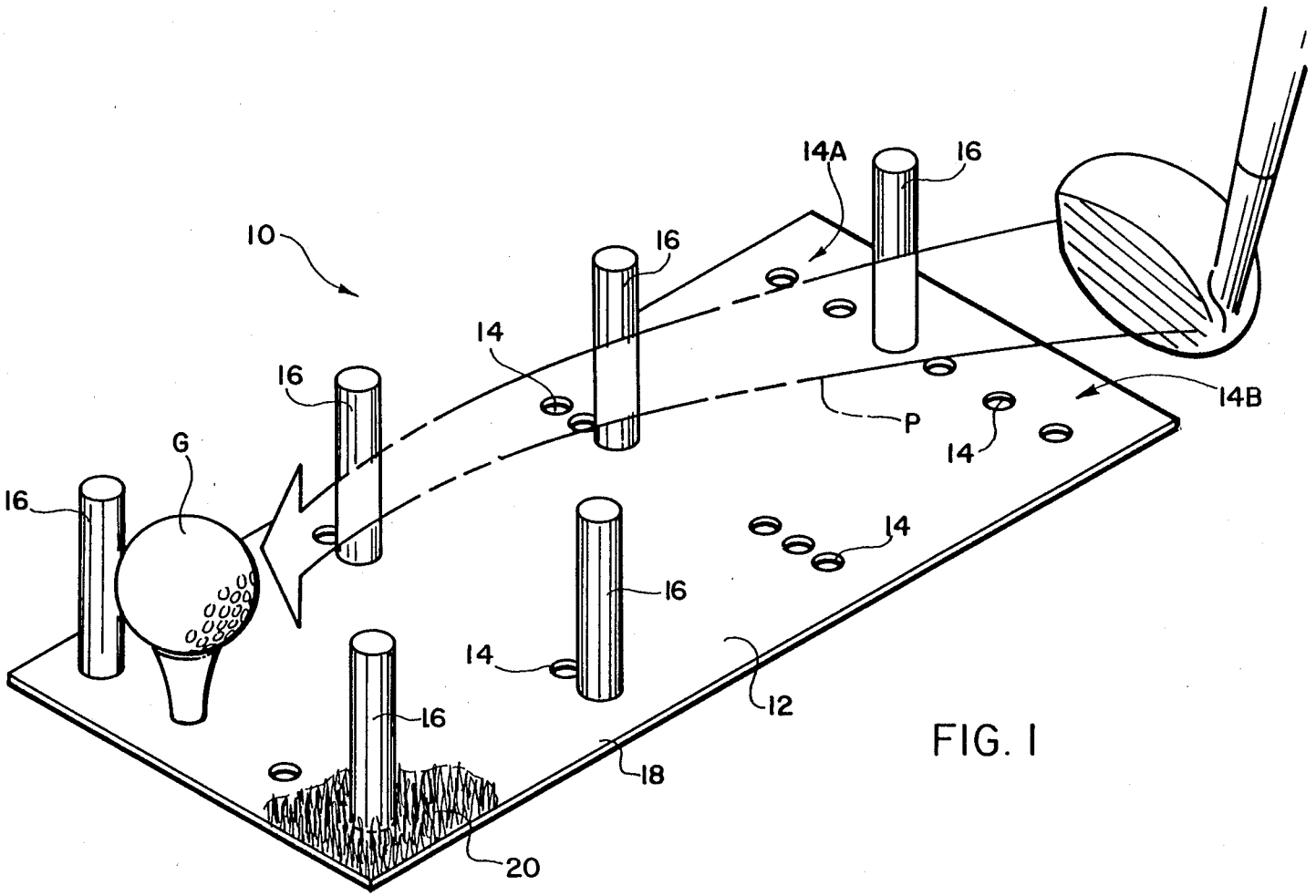
FIG. 1 is a perspective view of the golf club swing training device of the present invention as preferably embodied in a golf practice mat, illustrating the swing guide members in one possible arrangement.

Referring now to the accompanying drawings and initially to FIG. 1, a golf club swing training device according to the preferred embodiment of the present invention is indicated generally at 10 and basically includes a base 12 having a plurality of placement locations 14 whereat a plurality of swing guide members 16 may be removably positioned in various selective arrangements to define a variety of possible golf club swing paths, as representatively indicated at P.

Figure 2:
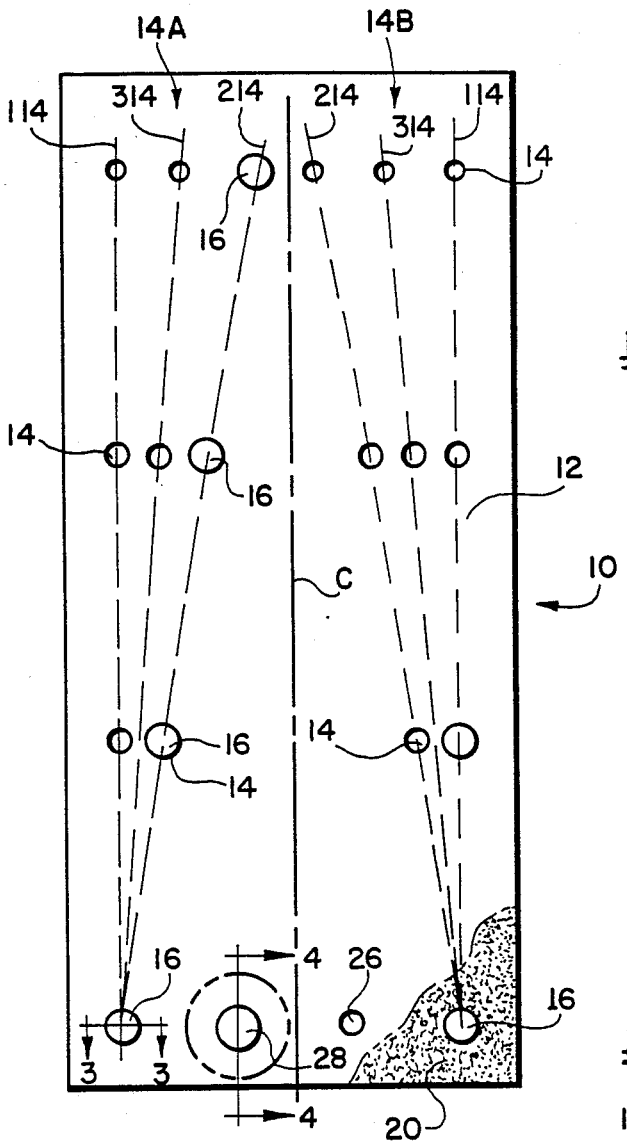
FIG. 2 is a top plan view of the golf practice mat of FIG. 1.

The base 12 preferably is formed as an essentially planar mat 18, the upper surface of which is covered by an artificial simulative grass-like material 20. In this manner, the mat 18 is adapted to be placed in generally facing parallel relation on any generally flat support surface suitable for practicing golf shots, e.g., at a golf driving range or in front of any appropriate conventional golf practice net structure. The base 12 is preferably rectangular with a central area extending lengthwise between forward and rearward ends of the base 12 being essentially unoccupied by any of the guide placement locations 14, the central area being represented by the longitudinal center line C of the base 12 in FIGS. 1 and 2.

The placement locations 14 are preferably formed in two groups, generally indicated at 14A, 14B, arranged in mirror-image relation to one another along the lengthwise extent of the base 12 at respective opposite sides of the longitudinal center line C. More specifically, each group 14A, 14B of the placement locations includes a series of the placement locations aligned at spacings along the base 12 in parallel relation to the longitudinal center line C, as represented by the placement locations 114. Additionally, each group 14A, 14B of the placement locations 14 includes another series of the placement locations 14 which are arranged laterally inwardly of the series 114 of placement locations at comparable spacings along the length of the base 12 in alignment with one another and with the forwardmost one of the placement locations 14 in the series 114 in oblique relationship with respect to the longitudinal center line C to diverge from the center line C in the direction from the rearward end to the forward end of the base 12, as indicated at 214. A further series of the placement locations 14, as indicated at 314, is arranged between the two series 114, 214 at comparable spacings along the length of the base 12 to align with the forwardmost placement location 14 of the series 114 in a less oblique diverging relationship with respect to the center line C.

Figure 3:
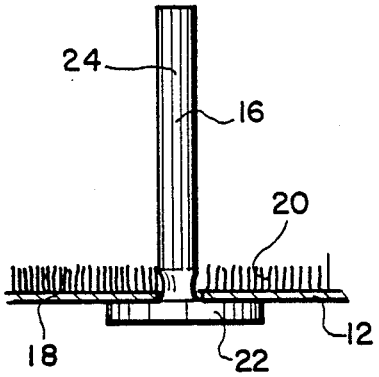
FIG. 3 is a partial vertical cross-sectional view of the golf practice mat taken along line 3—3 of FIG. 2 through one of the swing guide members.

As best seen in FIG. 3, each of the swing guide members 16 has a circular disc-like base 22 from which a linear post 24 extends in coaxial relationship. The swing guide members 16 are preferably formed of a resilient material, such as natural or synthetic rubber, which provides flexibility and compressibility of the post 24. The post 24 is of a slightly larger cross-sectional diameter than the diametric dimension of the openings in the base 12 defining the placement locations 14. Thus, each swing guide member 16 may easily be positioned at any desired placement location 14 by inserting the post 24 upwardly through the respective opening in the base 12 from the underside thereof until the disc-like base 22 of the guide member 16 is seated against the underside of the base 12, the base 12 slightly compressing the adjacent region of the post 24 to frictionally retain the guide member in place. Of course, as those persons skilled in the art will recognize, the swing guide members 16 and the placement locations 14 of the base 12 may be of any other suitable compatible configuration for installing and retaining the guide members 16 in place. For example, the posts 24 of the swing guide members 16 and the openings in the base 12 at each placement location 14 could be formed of the same diameter and circular recesses could be formed in the underside of the base 12 coaxial with each opening for seating therein of the disk-like base 22 of a guide member 16.

Figure 4:
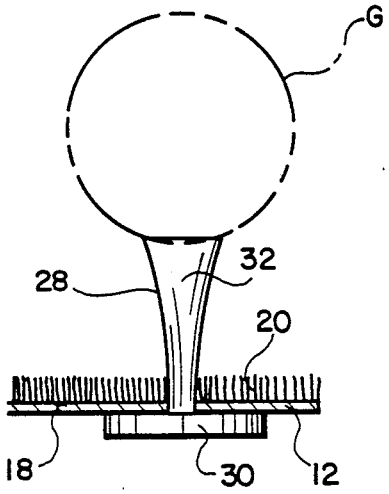
FIG. 4 is another vertical cross-sectional view of the golf practice mat taken along line 4—4 of FIG. 2 through the golf tee.

A pair of openings 26 are also formed through the base 12 at its forward end at opposite sides of the longitudinal center line C to provide mounting locations for a ball-supporting tee 28. The tee 28 has a circular disc-like base 30 from which a frusto-conical ball support post 32 extends in coaxial relationship. The tee 28 is also preferably formed of a suitably resilient material, such as natural or synthetic rubber, and is fitted in a selected one of the openings 26 by insertion therethrough in the same manner as above-described with respect to the swing guide members 16, as will best be seen and understood in FIG. 4. The outward end of the ball-supporting post 32 is either hollow or formed with a concave recess to receive the spherical periphery of a golf ball G.

The use and operation of the swing training device 10 may thus be understood. For use by a right-handed golfer, the golfer will of course assume a stance alongside the right lateral side (as viewed in FIGS. 1 and 2) of the base 12. When the golfer desires to practice a normal full golf swing requiring a traditional inside-to-square swing plane, a swing guide member 16 will be placed in the forwardmost placement location 14 of the series 114 in the group 14A opposite the center line C from the golfer's stance and a swing guide member 16 will be placed in each of the placement locations 14 of one or the other of the series 214 or 314 in the same group 14A. Likewise, a swing guide member 16 is placed in each of the two forwardmost placement locations 14 of the series 114 in the group 14B at the same side of the center line C as the golfer's stance is taken. The tee 28 is placed in the opening 26 at the side of the center line C opposite the golfer's stance. In this manner, the swing guide members 16 as thusly placed define therebetween a swing guide path P through which the club head should be swung by the golfer to strike a ball supported on the tee 28 with a correct inside-to-square swing. As will be noted, the oblique orientation of the swing guide members 16 placed in the group 14A defines the desired obliqueness of the inside-to-square swing plane to be followed by the golfer, while the swing guide members 16 placed in the group 14B provide a reference against an overly exaggerated inside-to-square swing. If the golfer deviates too greatly from the desired swing plane, the club head of his golf club will strike one of the swing guide members 16 to alert the golfer of his incorrect swing. Notably, the swing guide members 16, however, are sufficiently flexible and resilient that no damage to the golf club occurs and the stricken swing guide members 16 immediately return to their original upstanding disposition. As an alternative, swing guide members 16 may be placed at the forwardmost placement location 14 in the set 114 and in the placement locations 14 of the other series 214, 314, thereby to define a more or less oblique inside-to-square swing path, as necessary or desirable. As will of course be understood, a left-handed golfer would assume a stance at the opposite longitudinal side of the base 12 and would utilize the placement locations 14 in the two groups 14A, 14B and the other tee position 26 in the reverse mirror-image of that described above. Of course, as those persons skilled in the art will readily recognize, placement locations 14 may be arranged in greater or lesser numbers and in additional or other relative positions to permit the selective positioning of swing guide members in any number of desired relationships with respect to one another to cooperatively define any other possible golf club swing paths so as to accommodate any other swing training program or programs. For example, each group 14A, 14B could be provided with additional placement locations 14 forwardly of the tee to allow additional swing guide members 16 to be placed at the side of the center line C opposite the golfer's stance to define the desired continuation of the golf club head to the "inside" of the golfer's stance after striking the ball, thereby to train the golfer's swing not to cross to the "outside" of the intended line of ball travel, which would tend to "push" the golfball in the same direction as a slice.

Figure 5:
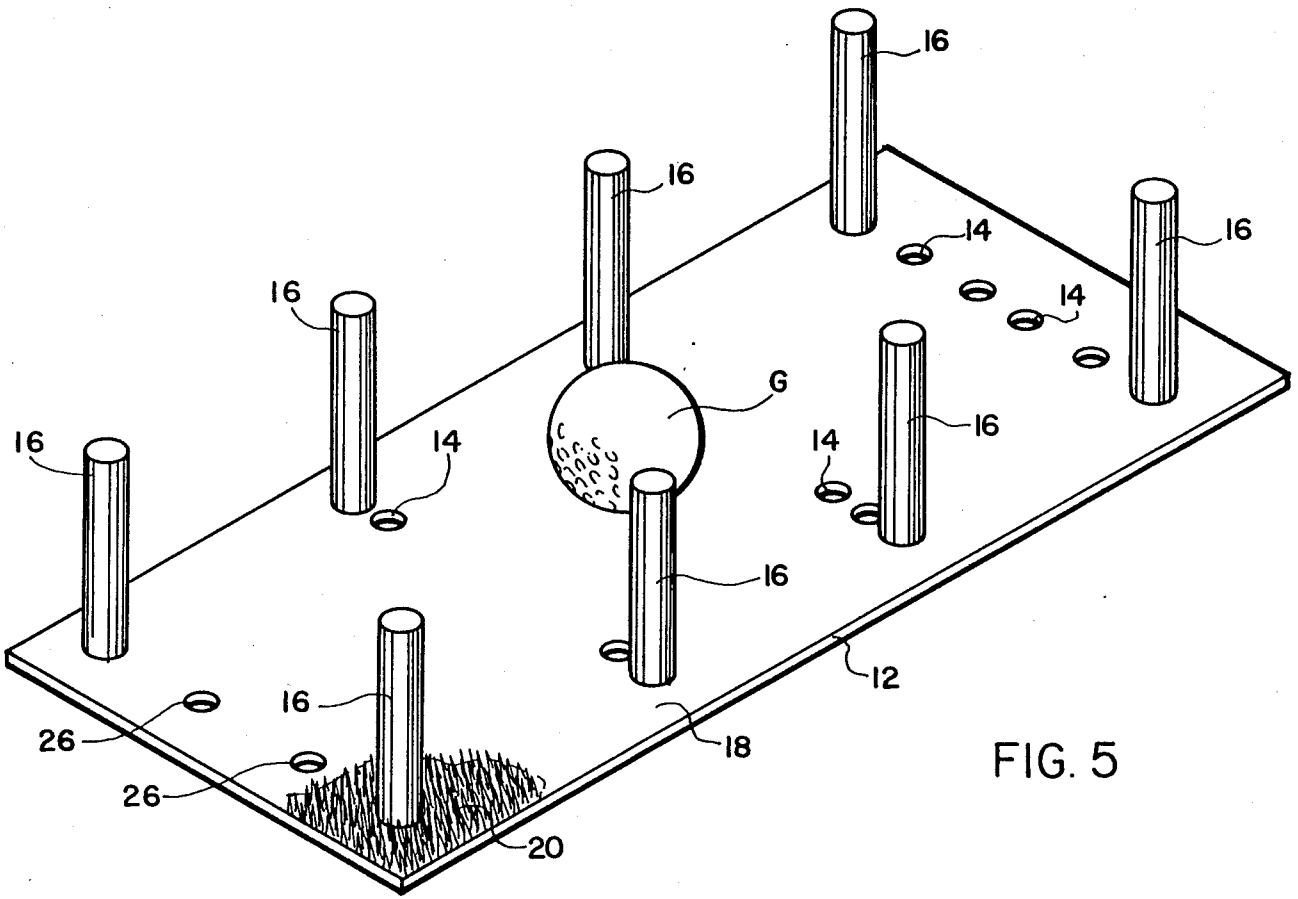
FIG. 5 is another perspective view of the golf practice mat of FIG. 1, showing the swing guide members in another possible arrangement.

Turning now to FIG. 5, the swing training device 10 is shown with the tee 28 removed and with swing guide members 16 positioned at each placement location 14 in the set 114 of each group 14A and 14B so as to define a golf club swing path which extends substantially parallel to the golfer's stance, whether left-handed or right-handed, and which is of a substantially uniform widthwise dimension between the swing guide members 16 for substantially the full length of the base 12. This arrangement of the swing guide members 16 thus provides for practice of a golfer's chipping stroke which is utilized for making golf shots of a relatively short distance which require the greatest degree of accuracy. In contrast to a full golf club swing which as noted above should follow an inside-to-square swing club plane, it is generally accepted that short chip shots should be made using a putting-style stroke wherein the golfer's backswing and subsequent forward through-swing in stroking the golf ball is much more restricted and is accomplished by swinging only the golfer's arms while his wrists are maintained in an essentially fixed relationship throughout the swing. In such a swing, the club head must follow a line of movement in advance of and following the striking of the golf ball which is essentially in line with the intended path of ball travel, i.e. parallel to the golfer's stance. Accordingly, in the described disposition of the swing guide members 16, the members 16 define such a desired golf club head swing path. In use, the golf ball is placed, as shown, at essentially the lengthwise centerpoint of the base 12, whereby the swing guide members 16 direct the golfer to cause the club head to move in parallel relation to the golfer's stance immediately in advance of and following the striking of the ball. As described above, if the golfer's club head swing path deviates too greatly from the desired swing path, the golf club will strike one or more of the guide members 16 to alert the golfer of the incorrect swing, the guide members 16 resiliently returning to their original upstanding disposition for continued use of the swing training device 10.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. Apparatus for training a user to swing a golf club in a predetermined desired swing path, comprising a generally planar base for disposition on a generally flat practice surface in generally parallel facing relation thereto, said base including a linear central swing path area extending between forward and rearward ends of said base for disposition of said base during use with said central area essentially parallel to a user's stance along one lateral side of said base, said central area including a golf ball support, a golf ball supported thereon, a first set of said swing guide members arranged along the side of said central area opposite said one lateral side of said base in an oblique alignment with respect to said central area with the rearwardmost swing guide member more closely spaced to said central area than the forwardmost swing guide member, and a second set of said swing guide members arranged along the same side of said central area as said one lateral side of said base in a parallel alignment with respect to said central area, the forwardmost one of each said set of said swing guide members being located generally laterally adjacent said golf ball support, said first and second sets of swing guide members defining therebetween an oblique "inside-to-square" golf club swing path to said golf ball support.

2. Apparatus for training a user to swing a golf club in a predetermined desired swing path according to claim 1 and characterized further in that said first set of said swing guide members is of a greater number than said second set of said swing guide members.

3. Apparatus for training a user to swing a golf club in a predetermined desired swing path according to claim 1 and characterized further in that said golf ball support comprises a tee.

4. Apparatus for training a user to swing a golf club in a predetermined desired swing path according to claim 3 and characterized further in that said tee is selectively removable for use of said apparatus without a tee.

5. Apparatus for training a user to swing a golf club in a predetermined desired swing path, comprising a generally planar base for disposition on a generally flat practice surface in generally parallel facing relation thereto, and a plurality of swing guide members, said base including a linear central swing path area extending between forward and rearward ends of said base for disposition of said base during use with said central area essentially parallel to a user's stance along one lateral side of said base, said base including indicia defining a plurality of placement locations each adapted for removable disposition thereat of one said swing guide member in upstanding relation with respect to said base, said placement indicia being arranged at spacings about opposite lateral sides of said central area of said base to permit said guide members to be selectively positioned in diverse relationships with respect to one another for cooperatively defining a variety of possible golf club swing paths to accommodate differing swing training uses, each lateral side of said base having a first set of said placement indicia arranged in an alignment oblique with respect to said central area with the rearwardmost placement indicia more closely spaced to said central area than the forwardmost placement indicia and a second set of placement indicia arranged in an alignment parallel with respect to said central area, first and second sets of said swing guide members being selectively disposed in one of the following arrangements: (a) said first set of said swing guide members being disposed at one lateral side of said central area at said placement locations defined by the respective said first set of placement indicia and said second set of said swing guide members being disposed at the other lateral side of said central area at said placement locations defined by the respective said second set of placement indicia, for defining an oblique "inside-to-square" swing path for a user of one hand; (b) said first set of said swing guide members being disposed at said other lateral side of said central area at said placement locations defined by the respective said first set of placement indicia and said second set of said swing guide members being disposed at said one lateral side of said central area at said placement locations defined by the respective said second set of placement indicia for defining an oblique "inside-to-square" swing path for a user of the opposite hand; and (c) said first and second sets of said swing guide members being disposed at each side of said central area at said placement locations defined by the respective said second sets of placement indicia, for defining a parallel swing path for a user of either hand.

6. Apparatus for training a user to swing a golf club in a predetermined desired swing path according to claim 5 and characterized further in that each said placement indicia comprises an opening in said base and each said guide member is configured for fitted receipt in one said opening.

7. Apparatus for training a user to swing a golf club in a predetermined desired swing path according to claim 5 and characterized further by a tee mounted in said central area for supporting a golf ball.

8. Apparatus for training a user to swing a golf club in a predetermined desired swing path according to claim 7 and characterized further in that said tee is selectively removable from said central area for use of said apparatus without said tee.

9. Apparatus for training a user to swing a golf club in a predetermined desired swing path according to claim 5 and characterized further in that said central area includes a golf ball support, the forwardmost one of each said set of said placement indicia being located generally laterally adjacent said golf ball support.

10. Apparatus for training a user to swing a golf club in a predetermined desired swing path according to claim 5 and characterized further in that said first set of said swing guide members is of a greater number than said second set of said swing guide members.

* * * * *